US006007063A

United States Patent [19]

Park

[11] Patent Number: 6,007,063

[45] Date of Patent: Dec. 28, 1999

[54] PAPER OUTPUT UNIT FOR INK-JET PRINTER

[75] Inventor: Gyeong-Ho Park, Kyungki-do, Rep. of Korea

[73] Assignee: SamSung Electronics Co., Ltd., Kyungki-do, Rep. of Korea

[21] Appl. No.: 08/815,377

[22] Filed: Mar. 10, 1997

[30] Foreign Application Priority Data

Mar. 8, 1996 [KR] Rep. of Korea ..... 96-6140

[51] Int. Cl.[6] ..... B65H 5/02; B65H 5/22

[52] U.S. Cl. ..... 271/273; 271/3.09; 271/4.04; 271/3.15; 271/3.17

[58] Field of Search ..... 271/273, 3.09, 271/240, 3.17, 3.15, 4.04; 346/138; 347/16; 400/55, 624, 636

[56] References Cited

U.S. PATENT DOCUMENTS 5,152 10/1847 Rasmussen et al. .
5,121,139 6/1992 Burke .
5,216,442 6/1993 Parks et al. .
5,291,227 3/1994 Suzuki .
5,595,380 1/1997 McCue Jr. et al. .

*Primary Examiner*—Donald P. Walsh
*Assistant Examiner*—Daniel K. Schlak
*Attorney, Agent, or Firm*—Robert E. Bushnell, Esq.

[57] ABSTRACT

A paper output unit for an ink-jet printer includes: a feed roller for feeding individual sheet of print media into the printer in which the feed roller first rotates in a reverse direction to align a top edge of each individual sheet of print media along a surface before each feeding of the individual sheet of print media into the printer, and then rotates in a forward paper transport direction to feed the individual sheet of print media into the printer for printing; a delivery roller for ejecting the individual sheet of print media led from the feed roller and transported along the paper transport direction in a paper path between the feed roller and the delivery roller upon completion of printing of the individual sheet of print media; a transmission roller for controlling rotation of the feed roller and the delivery roller; a friction star wheel for applying a pushing force to the individual sheet of print media as the individual sheet of print media is being conveyed to the delivery roller so as to prevent the individual sheet of print media from slipping off the delivery roller; and a delivery roller shifting unit for shifting the delivery roller away from the friction star wheel each time the feed roller rotates in the reverse direction.

20 Claims, 6 Drawing Sheets

PAPER OUTPUT UNIT FOR INK-JET PRINTER

CLAIM FOR PRIORITY

This application makes reference to, incorporates the same herein, and claims all benefits accruing under 35 U.S.C. §119 from an application for PAPER OUTPUT UNIT FOR INK-JET PRINTER earlier filed in the Korean Industrial Property Office on Mar. 8, 1996 and there duly assigned Serial No. 96-6140.

BACKGROUND OF THE INVENTION

1. Technical Field

The present invention relates to a paper output unit for an ink-jet printer, and more particularly, relates to a paper jam-free output apparatus for an inkjet printer for preventing paper jams that may occur due to the reverse rotation of a paper drive mechanism which feeds the next paper when the current paper on which printing is completed has not been output yet to a top output tray.

2. Related Art

Conventional ink-jet printers typically include a paper feeding unit for feeding each individual sheet of paper into the printer, a paper conveyance unit for conveying or transport each sheet of paper fed from the paper feeding unit through a print zone for printing, a print unit for printing images on the sheet of paper as the sheet of paper is transported through the print zone during a print cycle, and a paper output unit for delivering the sheet of paper on which printing is completed through the print unit to an output tray generally placed outside of the printer. Exemplary configurations of such an ink-jet printer are disclosed in U.S. Pat. No. 5,595,380 for *Sheet Media Handling System For Aligned Insertion Of Single Sheet Medium* issued to McCue, Jr. et al., U.S. Pat. No. 5,291,227 for *Ink Jet Printer Having Improved Paper Transport Mechanism* issued to Suzuki, U.S. Pat. No. 5,216,442 for *Moving Platen Architecture For An Ink Jet Printer* issued to Parks et al., U.S. Pat. No. 5,152,622 for *Printer With Improved Anti-Skew Mechanisms* issued to Rasmussen et al., and U.S. Pat. No. 5,121,139 for *Compact Ink Jet Printer Having A Drum Drive Mechanism* issued to Burke.

Generally, each sheet of paper is delivered to the paper transport unit from the paper feeding unit. A paper feed roller first rotates in a reversed, clockwise direction so as to align the sheet of paper for proper conveyance through the print zone for printing. When the sheet of paper is aligned for proper conveyance, the paper feed roller then rotates in a forward, counter-clockwise direction so as to convey the sheet of paper through the print zone for printing. As the paper is being printed, a delivery roller of the paper output unit rotates to deliver the paper to the output tray. Simultaneous to the delivery of the printed paper, the paper feed roller also reverses its rotation so as to align a next sheet of paper for printing. As the paper feed roller begins to rotate in a reversed, clockwise direction, however, the tail end of paper as output by the paper output unit is often held back between the delivery roller and the friction star wheel, thus resulting in a paper jam.

One solution to this problem as I have recently observed is to install a paper output hook assembly having a delivery hook and gear in which the delivery hook is used to rotate in a paper output direction for pulling the paper that has been lightly caught between the delivery roller and the friction star wheel for complete delivery when the paper feed roller begins to rotate in a reversed, clockwise direction. However, this solution requires an especially constructed driving mechanism for the paper output hook assembly, and consumes valuable time for paper delivery which causes time delay and creates noise due to the operation of the paper output hook assembly. Moreover, a separate gear for operating the delivery hook and other complex parts and motors are necessarily required which increases the production costs and decreases the production yield.

SUMMARY OF THE INVENTION

Accordingly, it is therefore an object of the present invention to provide an especially constructed paper output unit for a compact, low-cost ink-jet printer.

It is an object of the present invention to provide a paper output unit for an ink-jet printer for preventing paper jams which often occur in the printer.

It is also an object of the present invention to provide a paper output unit for an ink-jet printer for preventing an individual sheet of paper that has not yet entirely delivered from the paper output unit from being drawn back into the printer, when the next sheet of paper is being aligned for printing.

These and other objects can be achieved by a paper output unit for an ink-jet printer which includes: a feed roller for feeding individual sheets of print media into the printer in which the feed roller first rotates in a reversed direction to align a top edge of each individual sheet of print media along a surface before each feeding of the individual sheet of print media into the printer, and then rotates in a forward paper transport direction to feed the individual sheet of print media into the printer for printing; a delivery roller for ejecting the individual sheet of print media fed from the feed roller and transported along the paper transport direction in a paper path between the feed roller and the delivery roller upon printing completion of the individual sheet of print media; a transmission roller for controlling rotation of the feed roller and the delivery roller; a friction star wheel for applying pushing force to the individual sheet of print media as the individual sheet of print media is being conveyed to the delivery roller so as to prevent the individual sheet of print media from slipping off the delivery roller; and a delivery roller shifting unit for shifting the delivery roller away from the friction star wheel each time the feed roller rotates in the reversed direction. The delivery roller shifting unit includes a mobile body having support panels at each distal end for supporting rotation of the delivery roller and slant contact portions for contacting the transmission roller, and a guide bracket mounted on a base of the printer for directing movement of the mobile body to shift the delivery roller away from the friction star wheel when the feed roller rotates in the reversed direction.

According to another aspect of the present invention, a paper output unit for an ink-jet printer includes: a friction star wheel positioned to guide individual sheet of print media; a delivery roller positioned in a spatial relation with the friction star wheel to eject the sheet of paper upon completion of printing; a mobile body for supporting the delivery roller; a guide bracket mounted on a base of the printer for directing movement of the mobile body; and a driving unit connected to the mobile body via a plunger shaft for controlling movement of the mobile body, thereby shifting the delivery roller in spatial relation with the friction star wheel in accordance with rotation of a feed roller feed the sheet of print media into the printer. The driving unit shifts the delivery roller toward the friction star wheel in direct contact to reject the sheet of print media from the printer when the feed roller rotates in a paper transport direction, and alternatively shifts the delivery roller away from the friction star wheel when the feed roller rotates in a direction opposite to the paper transport direction to align a next sheet of print media in position for printing.

According to still another aspect of the present invention, a paper output unit for an ink-jet printer includes a friction star wheel positioned to guide individual sheet of print media; a delivery roller positioned in a spatial relation with the friction star wheel to eject the sheet of paper upon completion of printing; a roller bracket having a pivot, a first distal end for supporting the delivery roller, and a second distal end connected to a plunger shaft, for rotating about the pivot to bring the delivery roller into direct contact with the friction star wheel for ejecting the individual sheet of print media from the printer when a feed roller feeding the sheet of print media into the printer rotates in a paper transport direction, and alternatively, to shift the delivery roller away from the friction star wheel when the feed roller rotates in a direction opposite to the paper transport direction to align a next sheet of print media in position for printing; and a driving unit connected to the roller bracket via the plunger shaft, for controlling movement of the roller bracket to thereby shifting the delivery roller in spatial relation with the friction star wheel in accordance with rotation of the feed roller.

The present invention is more specifically described in the following paragraphs by reference to the drawings attached only by way of example.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
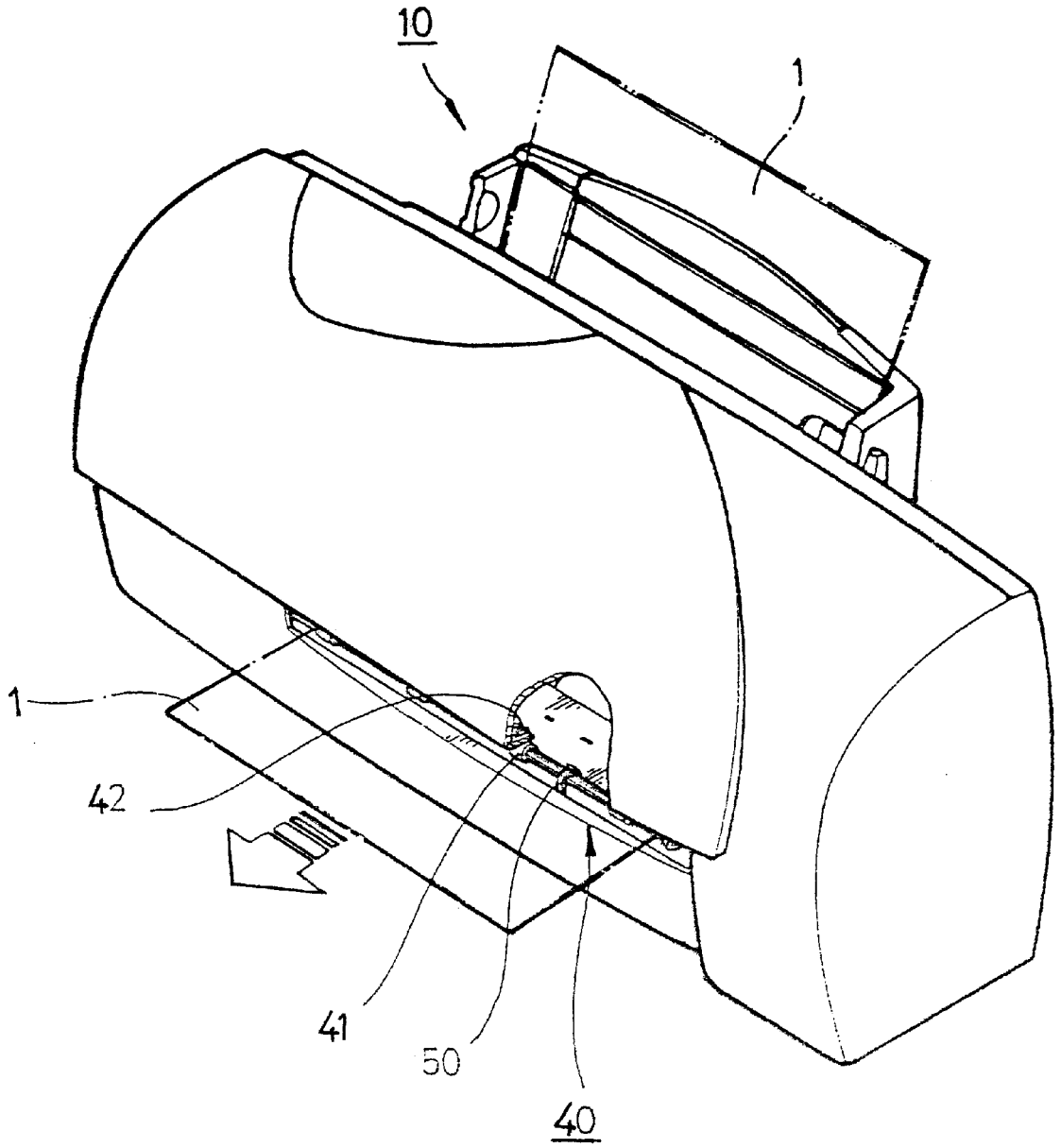
FIG. 1 is a cutaway perspective view of an exemplary ink-jet printer.
Figure 2:
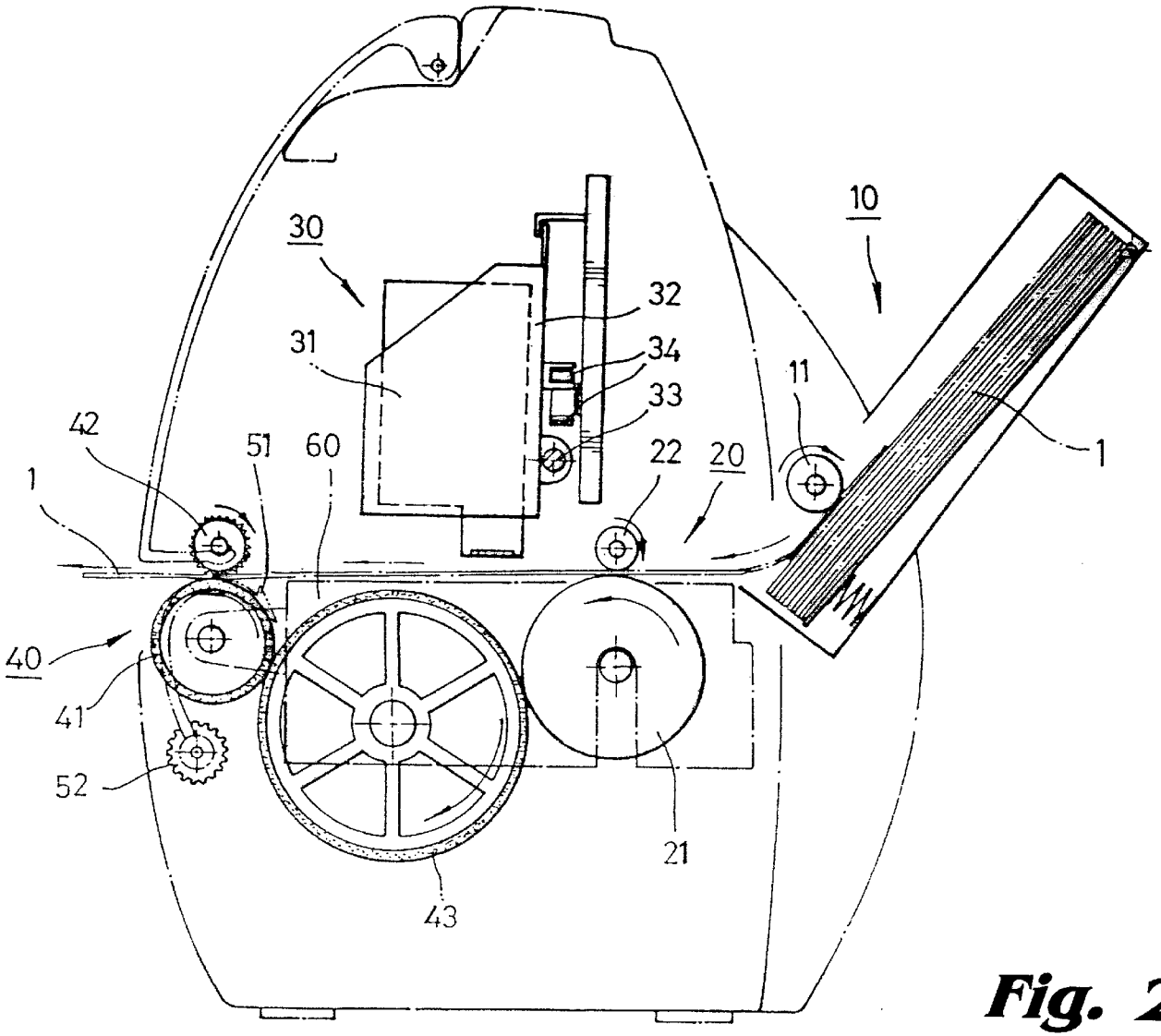
FIG. 2 is a sectional view of an exemplary ink-jet printer.

Referring now to the drawings, and particularly to FIGS. 1 and 2, which illustrate an exemplary ink-jet printer as contemplated in accordance with the principles of the present invention, the ink-jet printer includes a paper feed unit 10 for containing a stack of multiple sheets of paper 1 and feeding an uppermost sheet of paper 1 into a paper conveyance position, a paper conveyance unit 20 for conveying the uppermost sheet of paper 1 by one-line pitch at a time, a print unit 30 for printing images on the paper 1 conveyed by the paper conveyance unit 20, and a paper output unit 40 for outputting the paper 1 on which printing is completed through the print unit 30 to a top output tray placed outside of the printer.

The paper feed unit 10 includes a pickup roller 11 for picking each individual sheet of paper 1 contained in an input tray on a one-by-one basis and transporting the same to the paper conveyance unit 20. The paper conveyance unit 20 has a feed roller 21 and a pinch roller 22 that mutually rotate to convey the paper 1 to the print zone for printing characters or images on a line-by-line basis. When the paper 1 is transported to the paper conveyance unit 20, the feed roller 21 first rotates in a reversed, clockwise direction for the purpose of aligning the top edge of paper 1. This is necessary because the paper 1 fed by the pickup roller 11 may be drawn to one side during the conveyance, so that characters printed on paper 1 may be off centered.

When the top edge of paper 1 is aligned at the paper feed roller 21 of paper conveyance unit 20, the feed roller 21 then reverses its rotation and rotates in a forward, counterclockwise direction to convey the paper 1 into the print zone where the print unit 30 begins to print characters or images on the paper 1. The print unit 30 includes a cartridge 31 for printing characters on the paper 1 delivered from the paper conveyance unit 20, and a carriage 32 for carrying the cartridge 31 in a print direction for printing the characters or images on the paper 1. The carriage 32 is moved by a timing belt 34 under the guidance of a guide shaft 33. Characters are formed on paper 1 one line at a time by the cartridge 31 moved by carriage 32, and paper 1 is gradually moved to a guide frame 50. Paper output unit 40 includes a delivery roller 41 and a friction star wheel 42 that mutually rotate to deliver the printed paper to the output tray. The delivery roller 41 is driven by a power transmission roller 43 and the frictional star wheel 42 is rotated by rotation of the delivery roller 41.

Power transmission roller 43 is actuated by paper feeding roller 21 that rotates by power generated from the printer's driving section. Paper 1 passes between the delivery roller 41 and the friction star wheel 42 to be output to the top output tray. Delivery roller 41's outer surface is made of rubber so that paper 1 comes in close contact with delivery roller 41. Power transmission roller 43's outer surface is made of rubber with high friction factor to assure proper power transmission with delivery roller 41.

When the paper feed roller 21 rotates in a forward direction (i.e., counter-clockwise direction when viewed from FIG. 2), the power transmission roller 43 rotates in an opposite direction to enable the delivery roller 41 to rotate in a counter-clockwise direction to output paper 1 to the top output tray. In the procedure of printing paper 1 through print unit 30's cartridge 31 according to the overall driving mechanism, paper feeding roller 21 repeats forward rotation and stop operations, and after the printing of each sheet of paper 1 is completed, the paper feeding roller 21 continues to rotate in the forward direction so that paper 1 is output to the top output tray.

Paper 1 is delivered to the paper feed roller 21 as the pickup roller 11 of the paper feed unit rotates. As paper 1 is delivered to the paper feed roller 21, the paper feed roller 21 first rotates in a reversed direction (i.e., clockwise direction) under the control of the driving and control sections furnished with power by each of forward and reverse rotating motors in order to align the top edge of the paper 1 at the paper feed roller 21 for proper conveyance to a print zone for printing. This is necessary because paper 1 fed from paper feed unit 10 may be drawn to one side according to circumstances so that characters printed on paper 1 may be off-centered.

When paper feed roller 21 rotates in the reverse direction for alignment of paper's top edge, the delivery roller 41, to which power transmission roller 43 applies power, also rotates in a reverse direction (i.e., clockwise direction). While paper 1, output by paper output unit 40, is not completely output but its tail is held between delivery roller 41 and friction star wheel 42, paper feeding roller 21 rotates reversely. In this occasion, paper 1 that is not completely output to the outside according to the reverse rotation of delivery roller 41 may be caught in friction star wheel 42, thus going backward to the printer's interior. This paper 1 is caught in cartridge 31's head or another roller, thus causing paper jam a and stopping operation of the printer.

One solution to this problem as I have observed is to install a paper output hook assembly in the paper output unit. The paper output hook assembly may include a delivery hook 50 and a hook axis 51 about which delivery hook 50 rotates. When paper feeding roller 21 rotates reversely, the delivery hook 50 rotates in a paper output direction in order to pull paper 1 that has been lightly caught between delivery roller 41 and friction star wheel 42, thus allowing paper 1 to be output completely. Unfortunately, however, the ink-jet printer equipped with this type of paper output hook assembly requires an additional driving mechanism, and consumes valuable time for paper delivery which results in time delay and creates noise due to the operation of the paper output hook assembly. Moreover, a separate gear 52 for operating the delivery hook 50 and other complex parts and motors are necessarily required which increases the production costs and decreases the production yield.

FIGS. 3, 4, 5A and 5B illustrate an especially constructed paper output unit for an ink-jet printer in accordance with a first preferred embodiment of the present invention.

Figure 3:
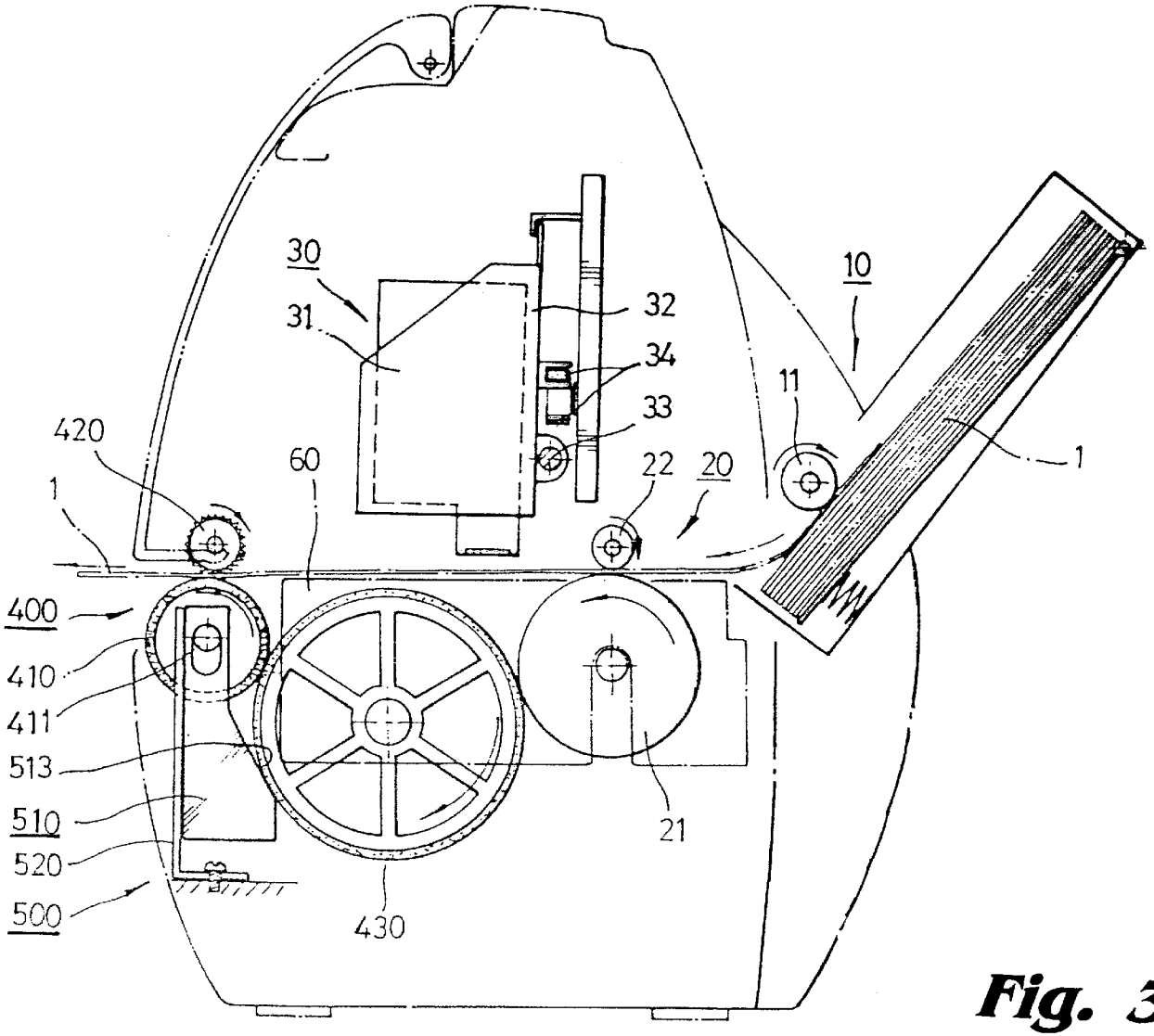
FIG. 3 is a sectional view of an ink-jet printer having a paper output unit constructed according to the principles of the present invention.

Referring to FIG. 3, an ink-jet printer equipped with the inventive paper output unit 400 includes a paper feeding unit 10 which holds a stack of paper 1 and feeds each sheet of paper 1 into its print unit, a paper conveyance unit 20 which has a paper feed roller 21 and a pinch roller 22 to convey every sheet of paper 1 by one-line pitch at a time, a print unit 30 which has a cartridge 31 for spraying ink particles and forming characters on paper 1, a carriage 32 for sliding cartridge 31 to right and left, a guide shaft 33 for moving carriage 31, and a timing belt 34. The operation and construction of these components are the same as those of the ink-jet printer shown in FIGS. 1 and 2, and thus their descriptions will be omitted for the sake of brevity.

Paper output unit 400 includes a power transmission roller 430, formed about a spring shaft 431 to contact paper feed roller 21 so as to receive its rotating force, a delivery roller 410, furnished with rotating force by power transmission roller 430, and a friction star wheel 420, formed over delivery roller 410 to produce a pressing force so as to output paper 1 to a top output tray. More specifically, paper feeding roller 21 and power transmission roller 430 are rotatably formed on a base frame 60, and friction star wheel 420 is supported by either a door cover (not shown) or an extra supporting frame of the ink-jet printer. Delivery roller 410 is installed so as to freely rotate in both forward and reverse directions. Delivery roller 410 is rotatably installed on a delivery roller shifting unit 500 formed in a paper output direction of base frame 60.

Figure 4:
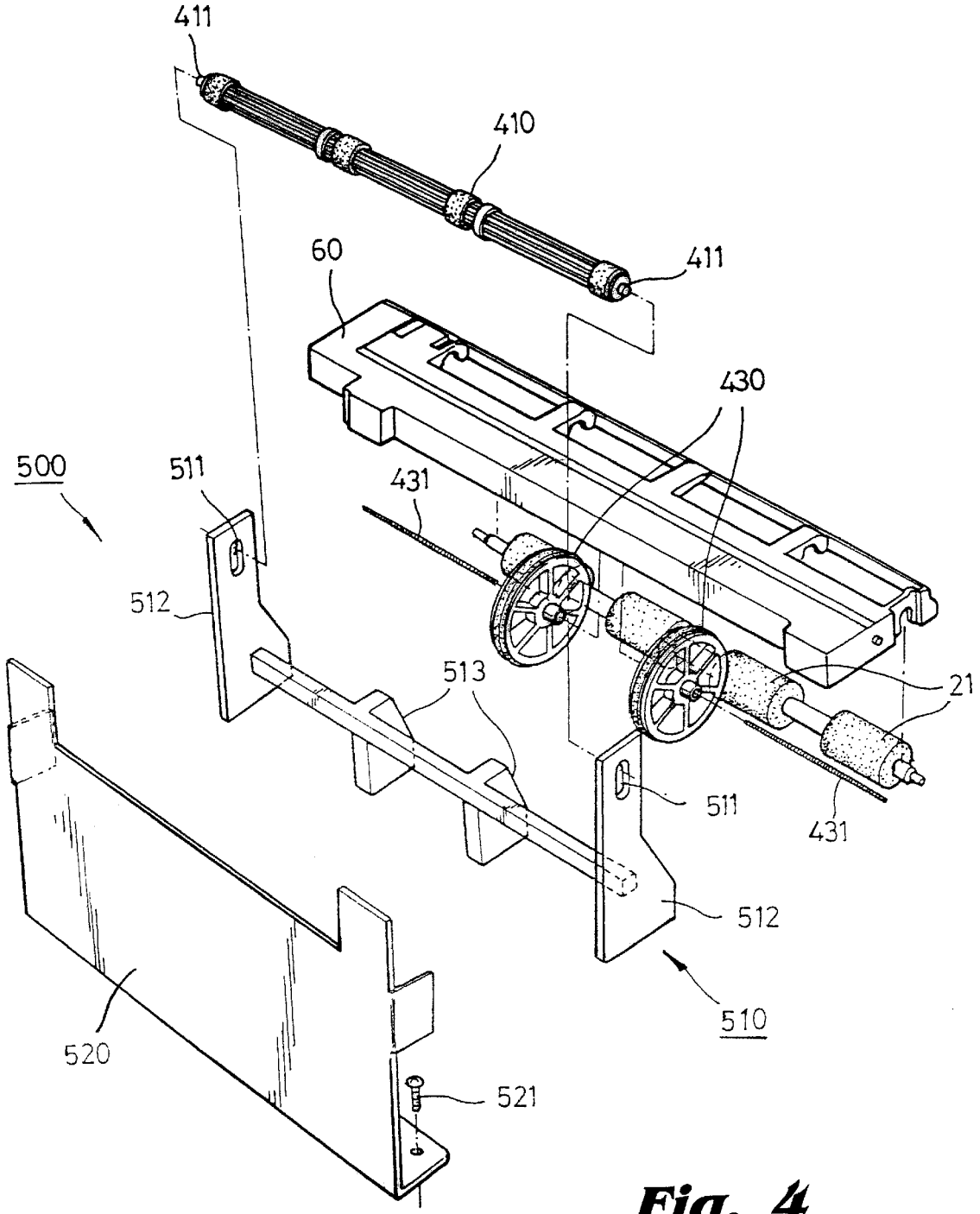
FIG. 4 is an exploded view of a paper output unit for an ink-jet printer as shown in FIG. 3.

Referring to FIG. 4 which is an exploded view of a paper output unit for an ink-jet printer as shown in FIG. 3, the delivery roller shifting unit 500 includes a mobile body 510 which moves the delivery roller 410, and a guide bracket 520 which guides the movement of mobile body 510. Mobile body 510 has a supporting panel 512 with a shaft hole 511 on its both sides, and slant contact portions 513 formed between supporting panels 512. Each of slant contact portions 513 has a slant part with a predetermined angle $\alpha$, and its lowermost part is larger than the part of supporting panel 512 where the shaft hole 511 is formed. It is preferable that supporting panels 512 are each integrally formed with slant contact portions 513, and they may be manufactured separately and assembled into mobile body 510. A roller shaft 411 is inserted into shaft holes 511 of supporting panels 512 and rotatably provided to the upper portion of mobile body 510. Preferably, the guide bracket 520, which is formed to be opposite to mobile body 510, is ⊏-shaped, and mobile body 510 slides under the guidance of guide bracket 520.

Figure 5A:
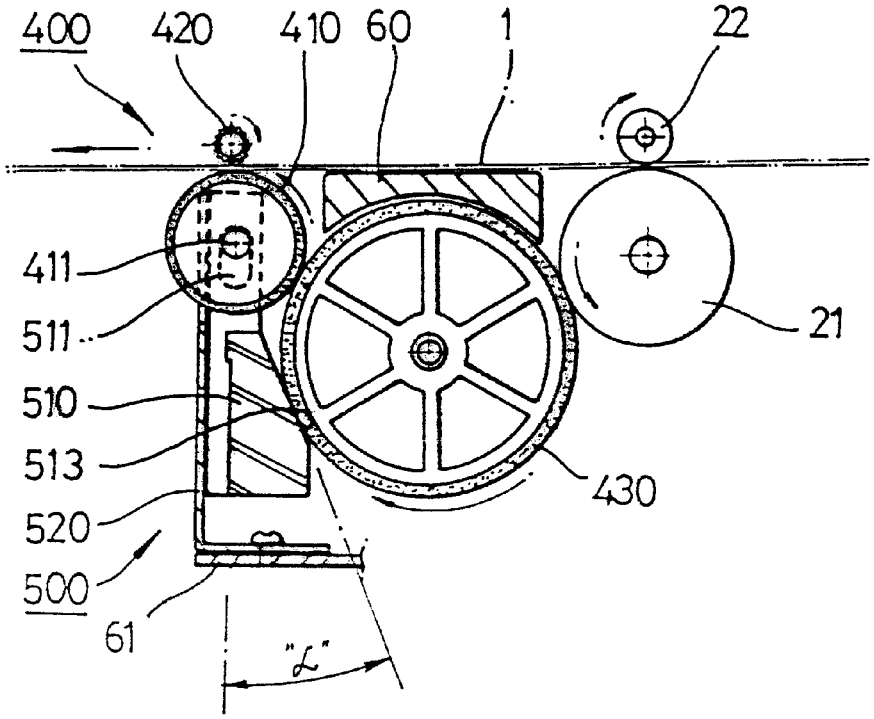
FIGS. 5A and 5B are side views of a paper output unit constructed according to a first preferred embodiment of the present invention.

FIG. 5A schematically depicts paper output unit 400 in accordance with the first preferred embodiment. As shown in FIG. 5A, the delivery roller 410 of mobile body 510 is located under friction star wheel 420 so that it contacts power transmission roller 430 and power transmission roller 430 contacts slant contact portion 513 of mobile body 510. Guide bracket 520 is fixed to a printer frame 61 or base frame 60 outside of mobile body 510 by the use of screws 521 so as to guide mobile body 510. In such a manner, mobile body 510 is installed on guide bracket 520 so as not to be pushed in the opposite direction of power transmission roller 430. Load acts on mobile body 510 including delivery roller 410. Delivery roller 410 comes in contact with power transmission roller 430 by the load, so power transmission roller 430 transmits the rotating force more efficiently.

The rotating force of power transmission roller 430 is transmitted to slant contact portion 513 of mobile body 510 that contacts power transmission roller 430, and when power transmission roller 430 rotates in a forward direction (i.e., clockwise direction), mobile body 510 generates a climbing force which moves the delivery roller 410 toward the friction star wheel 420, and facilitates the output of paper 1 positioned between delivery roller 410 and friction star wheel 420. Since slant contact portion 513 has the inclination angle $\alpha$ with respect to power transmission roller 430, paper slippage occurs between power transmission roller 430 and slant contact portion 513. At this point, mobile body 510 has little climbing force, and there is no difficulty in the normal operation of paper output unit 400.

Figure 5B:
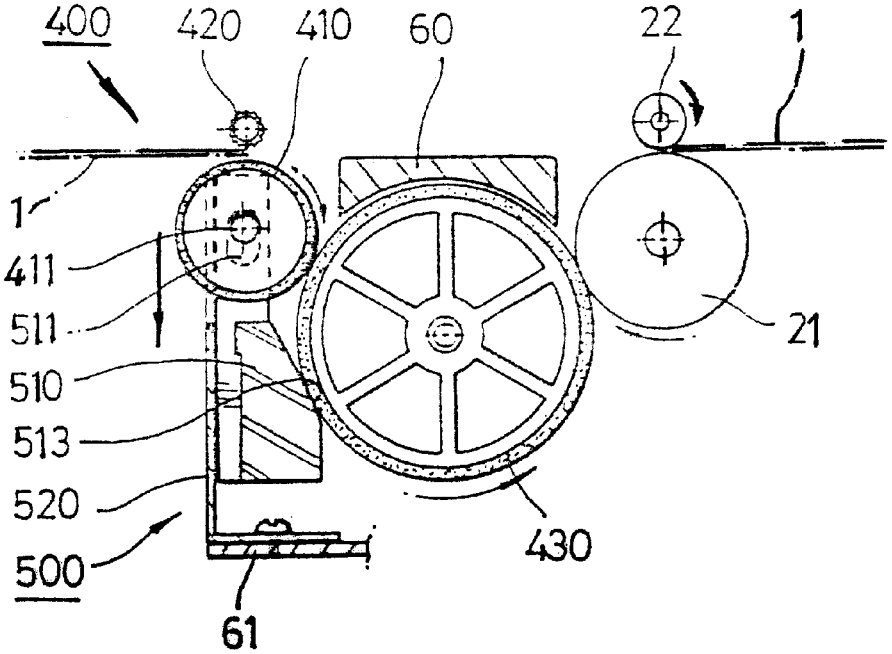

FIG. 5B shows the operating state of paper output unit 400 when paper feeding roller 21 rotates reversely for alignment of paper 1's top edge. That is, as paper feeding roller 21 rotates in a clockwise direction, the power transmission roller 430 rotates in a counterclockwise direction. Therefore, as a reverse rotating force acts downward on slant contact portion 513 of mobile body 510 contacting power transmission roller 430, mobile body 510 moves downward. Accordingly, the moment that is provided to mobile body 510 moves delivery roller 410 downward, delivery roller 410 is separated from friction star wheel 420, and guide bracket 520 serves to guide mobile body 510.

When delivery roller 410 moves a little downward so as to be spaced apart from friction star wheel 420, delivery roller 410 does not apply pressure to paper 1 that is not completely output therefrom. Thus, even if delivery roller 410 rotates in a reverse direction, paper 1 is not conveyed backward to the printer. Paper feed roller 21 rotates in a reverse direction two (2) to three (3) times under the control of the printer's control section to align paper 1's top edge, and rotates in a forward direction for normal paper conveyance so that power transmission roller 430 rotates in a clockwise direction. Therefore, a climbing force is applied to slant contact portion 513 by the forward rotating force of power transmission roller 430, and mobile body 510 is then moved upward by guide bracket 520. Thus, delivery roller 410 returns to its normal state shown in FIG. 5A and performs normal paper output function.

Figure 6:
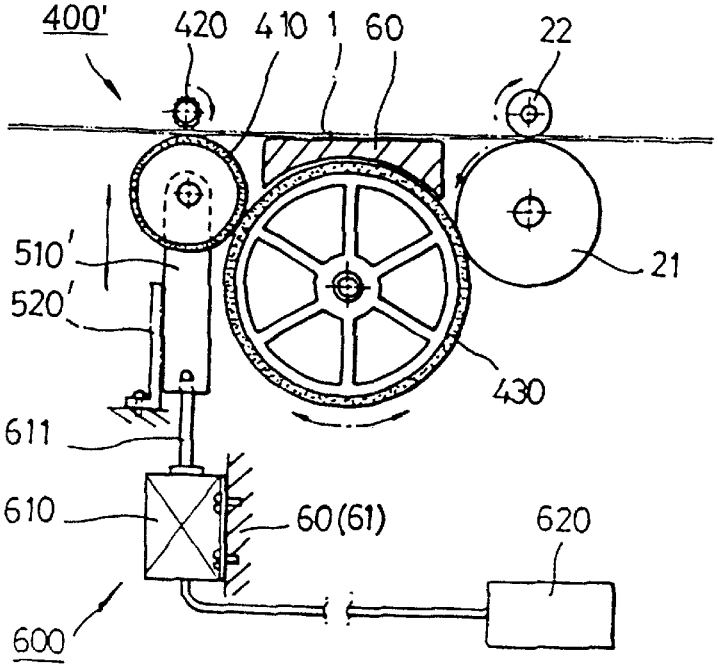
FIG. 6 is a side view of a paper output unit constructed according to a second preferred embodiment of the present invention.

FIG. 6 illustrates a paper output unit 400' for an ink-jet printer as constructed in accordance with a second embodiment of the present invention. Delivery roller 410, to which the rotating force is applied by power transmission roller 430, is moved so as to be separated from the friction star wheel 420 by a driving unit 600 for spacing of delivery roller 410. Driving unit 600 includes a solenoid 610 that serves as a power source according to a control portion 620. Solenoid 610's plunger shaft 611 is connected to mobile body 510' to which delivery roller 410 is rotatably provided. Accordingly, when the solenoid 610 is actuated under the control of control portion 620 to make plunger shaft 611 move forward, the delivery roller 410 is moved forward to come in contact with the friction star wheel 420. At this point, as paper feeding roller 21 rotates in a forward direction, the paper output unit 400' also rotates in the forward direction to normally output paper 1 on the top output tray.

When the paper feeding roller 21 rotates in a reverse direction for alignment of paper's top edge, solenoid 610's plunger shaft 611 moves reversely under the control of control portion 620, so that the delivery roller 410 moves downward so as to be separated from the friction star wheel 420. The distance between delivery roller 410 and friction star wheel 420 is about two (2) to three (3) mm, and a little pressure acts between delivery roller 410 made of rubber and power transmission roller 430 contacting delivery roller 410 and does not adversely affect their rotation.

Paper output unit 400' of the second preferred embodiment may have a guide bracket 520' on one side of mobile body 510' in order to direct the up-and-down movement of mobile body 510'. Solenoid 610 is fixedly installed on base frame 60 or printer frame 61.

Figure 7:
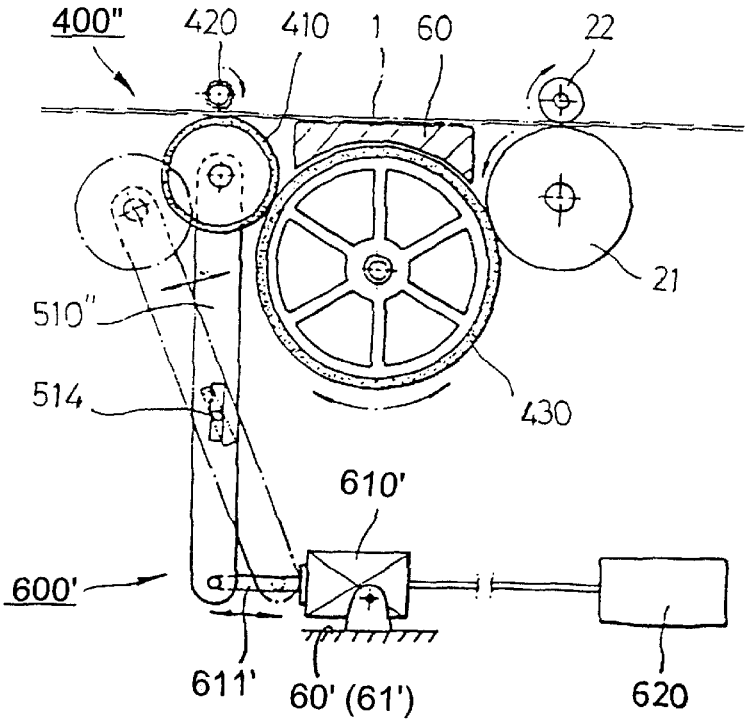
FIG. 7 is a side view of a paper output unit constructed according to a third preferred embodiment of the present invention.

FIG. 7 schematically depicts a paper output unit 400" constructed in accordance with a third preferred embodiment of the present invention. A roller bracket 510" having a delivery roller 410 is rotatable about a middle pivot 514. A driving unit 600' for spacing of delivery roller 410 is installed on the opposite side of delivery roller 410 to be connected with a plunger shaft 611' of a solenoid 610'. Plunger shaft 611' is moved forward and reversely under the control of a control portion 620'. Accordingly, control portion 620' allows plunger shaft 611' of solenoid 610' to move forward during the forward rotation of paper feeding roller 21 so that delivery roller 410 rotates contacting power transmission roller 430. In this manner, delivery roller 410 rotates contacting a friction star wheel 420, and smoothly outputs paper 1 to the printer's top output tray. When a paper feeding roller 21 rotates reversely for alignment of paper 1's top edge, plunger shaft 611' moves reversely under the control of control portion 620', and roller bracket 510" rotates counterclockwise about middle pivot 514. Thus, delivery roller 410 is separated from power transmission roller 430, and is also spaced from friction star wheel 420.

Paper 1 is not conveyed in the reverse direction by paper feeding roller 21's reverse rotation, and as paper feeding roller 21 rotates forward again, plunger shaft 611' of solenoid 610' moves forward under the control of control portion 620' so that delivery roller 410 contacts power transmission roller 430, thus being furnished with the rotating force. Simultaneously with this, delivery roller 410 contacts friction star wheel 420 to normally output paper 1 to the top output tray. Solenoid 610' is fixedly installed on base frame 60' or printer frame 61', similar to the second embodiment.

The present invention advantageously prevents the paper from returning to the printer during the reverse rotation of the paper feed roller for alignment of paper's top edge in order to avoid a paper jams. In addition, the delivery roller shifting unit that prevents paper reverse conveyance is of simple construction, and can be applied to common printers, thereby lowering the production costs and enhancing the productivity.

While there have been illustrated and described what are considered to be preferred embodiments of the present invention, it will be understood by those skilled in the art that various changes and modifications may be made in the paper output unit for an ink-jet printer, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. A paper output unit for an ink-jet printer, comprising:

a feed roller for feeding sheets of print media into the printer, said feed roller first rotating in a first direction to align a top edge of an individual sheet of print media along a surface of the feed roller before each feeding of the individual sheet of print media into the printer, and then rotating in a second direction opposite from said first direction to feed the individual sheet of print media into the printer for printing;

a delivery roller for ejecting the individual sheet of print media fed from said feed roller and transported along said second direction in a paper path between said feed roller and said delivery roller upon completion of printing of the individual sheet of print media;

a transmission roller for controlling rotation of said feed roller and said delivery roller;

a friction star wheel for applying a pushing force to the individual sheet of print media as the individual sheet of print media is conveyed to said delivery roller so as to prevent the individual sheet of print media from slipping off said delivery roller; and delivery roller shifting means responsive to rotation of said feed roller in said first direction for shifting said delivery roller away from said friction star wheel.

2. The paper output unit of claim 1, said delivery roller shifting means comprising:

a mobile body having support panels at each end thereof for supporting said delivery roller and slant contact portions formed between the support panels for contacting said transmission roller; and a guide bracket mounted on a base of the printer for directing movement of the mobile body to shift said delivery roller away from said friction star wheel when said feed roller rotates in the first direction.

3. The paper output unit of claim 2, said transmission roller rotating in said first direction for enabling the slant contact portions of said mobile body to lift said mobile body and said delivery roller upward to contact said friction star wheel when said feed roller rotates in said second direction.

4. The paper output unit of claim 2, said transmission roller rotating in said second direction for enabling the slant contact portions of said mobile body to shift said mobile body and said delivery roller downward away from said friction star wheel when said feed roller rotates in said first direction.

5. The paper output unit of claim 2, said support panels of said mobile body each having a shaft hole for accommodating ends of said delivery roller.

6. The paper output unit of claim 5, each of said slant contact portions exhibiting an oblique angle to flexibly accommodate a surface of said transmission roller.

7. The paper output unit of claim 1, said delivery roller shifting means comprising:

a mobile body for supporting said delivery roller;

a guide bracket mounted on a base of the printer for directing movement of the mobile body; and a driving unit connected to said mobile body via a plunger shaft for controlling movement of said mobile body to thereby shift said delivery roller in relation to said friction star wheel in accordance with rotation of said feed roller.

8. The paper output unit of claim 7, said driving unit shifting said delivery roller toward said friction star wheel for rejecting the individual sheet of print media when said feed roller rotates in said second direction.

9. The paper output unit of claim 8, said driving unit shifting said delivery roller away from said friction star wheel when said feed roller rotates in said first direction to align a top edge of a next sheet of print media along the surface of said feed roller.

10. The paper output unit of claim 7, said mobile body being shifted by said driving unit in a vertical direction under the guidance of the guide bracket.

11. The paper output unit of claim 7, said driving unit comprising a solenoid.

12. The paper output unit of claim 1, said delivery roller shifting means comprising:

a plunger shaft;

a roller bracket having a pivot, a first end for supporting said delivery roller, and a second end connected to said plunger shaft, said roller bracket rotating about said pivot to bring said delivery roller into direct contact with said friction star wheel for ejecting the individual sheet of print media when said feed roller rotates in said second direction, and to shift said delivery roller away from said friction star wheel when said feed roller rotates in said first direction; and a driving unit connected to said plunger shaft for controlling movement of said roller bracket via said plunger shaft to thereby shift said delivery roller in spatial relation to said friction star wheel in accordance with rotation of said feed roller.

13. The paper output unit of claim 12, said driving unit comprising a solenoid.

14. A paper output unit for an ink-jet printer having a feed roller, said paper output unit comprising:

a friction star wheel positioned to guide sheets of print media;

a delivery roller positioned in a spatial relation to said friction star wheel to eject a sheet of paper upon completion of printing;

a mobile body having support panels at each end thereof for supporting said delivery roller; and a guide bracket mounted on a base of the printer for directing movement of the mobile body, said mobile body being responsive to rotation of said feed roller in a direction opposite to a paper transport direction for shifting said delivery roller away from said friction star wheel to align a next sheet of print media along a surface of the delivery roller before the feeding of the next sheet of print media into the printer and, alternatively, for bringing said delivery roller into direct contact with said friction star wheel to eject the sheet of print media from the printer in response to said feed roller rotating in said paper transport direction.

15. The paper output unit of claim 14, further comprising a transmission roller rotatably engaging said feed roller and said delivery roller to move said delivery roller into direct contact with said friction star wheel to reject the sheet of print media from the printer when said feed roller rotates in said paper transport direction.

16. The paper output unit of claim 14, further comprising a transmission roller rotatably engaging said feed roller and said delivery roller to move said delivery roller away from said friction star wheel when said feed roller rotates in said direction opposite to said paper transport direction.

17. The paper output unit of claim 14, said guide bracket having a ⊏-shape so as to direct movement of the mobile body in a vertical direction.

18. A paper output unit for an ink-jet printer having a feed roller, said paper output unit comprising:

a friction star wheel positioned to guide sheets of print media;

a delivery roller positioned in a spatial relation to said friction star wheel to eject a sheet of paper upon completion of printing;

a mobile body for supporting said delivery roller;

a guide bracket mounted on a base of the printer for directing movement of the mobile body;

a plunger shaft connected to the mobile body; and a driving unit connected to said plunger shaft for controlling movement of said mobile body to thereby shift said delivery roller in spatial relation to said friction star wheel in accordance with rotation of the feed roller to feed the sheet of print media into the printer, said driving unit shifting said delivery roller toward said friction star wheel and into direct contact therewith for ejecting the sheet of print media from the printer in response to said feed roller rotating in a paper transport direction and, alternatively, shifting said delivery roller away from said friction star wheel in response to said feed roller rotating in a direction opposite to said paper transport direction to align a next sheet of print media in position for printing.

19. The paper output unit of claim 18, said driving unit comprising a solenoid.

20. A paper output unit for an ink-jet printer having a feed roller for feeding sheets of print media into the printer, said paper output unit comprising:

a friction star wheel positioned to guide the sheets of print media;

a delivery roller positioned in a spatial relation to said friction star wheel to eject a sheet of paper upon completion of printing;

a plunger shaft;

a roller bracket having a pivot, a first end for supporting said delivery roller, and a second end connected to said plunger shaft, said roller bracket rotating about said pivot to bring said delivery roller into direct contact with said friction star wheel for ejecting the sheet of print media from the printer in response to the feed roller rotating in a paper transport direction and, alternatively, to shift said delivery roller away from said friction star wheel in response to said feed roller rotating in a direction opposite to said paper transport direction to align a next sheet of print media in position for printing; and a driving unit connected to said plunger shaft for controlling movement of said roller bracket to thereby shift said delivery roller in spatial relation to said friction star wheel in accordance with rotation of said feed roller.

* * * * *